US005421244A

United States Patent [19]

Hubbell et al.

[11] Patent Number: 5,421,244

[45] Date of Patent: Jun. 6, 1995

[54] SEGMENTED FLOW-THROUGH PISTON FOR USE IN A TORPEDO LAUNCHING SYSTEM

[75] Inventors: Richard F. Hubbell, West Kingston; James Cassidy, Wakefield, both of R.I.

[73] Assignee: The United States of America as represented by the Secretary of the Navy, Washington, D.C.

[21] Appl. No.: 183,411

[22] Filed: Jan. 14, 1994

[51] Int. Cl.[6] ..... F01B 31/00; F16J 1/00; B63B 1/00

[52] U.S. Cl. ..... 92/181 P; 92/182; 92/255; 114/238

[58] Field of Search ..... 92/179, 183, 192, 242, 92/249, 255, 182, 184, 185, 128, 181 P; 114/238, 239

[56] References Cited

U.S. PATENT DOCUMENTS

| | | | |
|---|---|---|---|
| 2,009,958 | 7/1935 | Hance | 92/255 |
| 2,295,160 | 9/1942 | Christenson | 92/255 |
| 3,426,655 | 2/1969 | Rumsey | 92/184 |
| 3,994,604 | 11/1976 | Visser | 92/128 X |
| 5,085,122 | 2/1992 | Berlam et al. | 114/238 X |
| 5,099,745 | 3/1992 | Hubbell et al. | 114/238 X |

FOREIGN PATENT DOCUMENTS

| | | | |
|---|---|---|---|
| 21855 | 11/1955 | Germany | 92/182 |

*Primary Examiner*—Edward K. Look
*Assistant Examiner*—Hoang Nguyen
*Attorney, Agent, or Firm*—Michael J. McGowan; Prithvi C. Lall; Michael F. Oglo

[57] ABSTRACT

An ejection pump apparatus of a torpedo launching system is provided with an improved water piston which is more stable during use and which enables the intake end of the water cylinder and the sea valve to have a smaller diameter than that of the piston. In order to assemble the piston through the smaller diameter opening, the piston is segmented into four pie-shaped segments which are assembled together in adjacent relation with bolt fasteners that extend through the sidewalls of the segments. The outer wall of the piston includes a circumferential slot which divides the outer wall into two spaced bearing lands which provide the piston with more stability. The circumferential slot also enable water to flow through the sidewall of the piston into the piston and outwardly through an open top thereof.

5 Claims, 3 Drawing Sheets

SEGMENTED FLOW-THROUGH PISTON FOR USE IN A TORPEDO LAUNCHING SYSTEM

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

1. Field of the Invention

The instant invention relates to torpedo launching systems and more particularly to a water cylinder and a segmented flow-through piston for use in a torpedo launching system.

2. Discussion of the Prior Art

Referring to FIGS. 1 and 2, a conventional torpedo launching system is illustrated and generally indicated at 10. The torpedo launching system comprises a torpedo tube assembly generally indicated at 12, a flood and drain system generally indicated at 14, and an ejection pump apparatus generally indicated at 16. The torpedo tube assembly 12 comprises a torpedo tube 18 having a breech door 20 and a muzzle door 22. The torpedo tube 18 is connected to an impulse tank 24 via slide valves 26. The torpedo tube 18 is also connected to the flood and drain system 14 via a pipe 28. During normal operating conditions, the breech and muzzle doors 20 and 22, and the slide valves 26 are closed and the torpedo tube 18 is filled with sea water. Prior to loading a torpedo 30 into the tube 18, sea water within the tube 18 is drained by the flood and drain system 14. After loading, the torpedo tube 18 is refilled by the flood and drain system 14 with sea water.

The torpedo 30 is launched from the torpedo tube 18 by means of the ejection pump apparatus 16. The ejection pump apparatus 16 comprises a water cylinder 32 having an external sea valve 34. The ejection pump apparatus further comprises an air cylinder 36. The water cylinder 32 is connected to the impulse tank 24 by ducts 38 (See FIG. 2). A one-piece water piston generally indicated at 40 is mounted in the water cylinder 32 and an air piston 42 is mounted in the air cylinder 36. The water piston 40 has a circumferential bearing land 44 and a tapered head 46. The water piston 40 and the air piston 42 are connected by a connector rod 48 which extends between the two cylinders 32 and 36. The air cylinder 36 is connected to a high pressure impulse flask 50 which supplies high pressure air to the air cylinder 36. Prior to launching, the water cylinder 32 is charged with sea water by opening the sea valve 34. Once the water cylinder 32 is charged with sea water, the impulse flask 50 supplies high pressure air to the connecting rod side of the air piston 42, forcing the air piston 42 in the direction of arrow 52. Air flow from the impulse flask 50 is shown by arrow 54. Movement of the air piston 42 pulls water piston 40 to the discharge end of the water cylinder 32 wherein the water in the water cylinder 32 is forced into the impulse tank 24 and then into the torpedo tube 18 to force the torpedo 30 out of the tube 18. As the water piston 40 nears the end of the ejection stroke, the bearing land 44 of the water piston 40 moves past the ducts 38 allowing water on the far side of the piston 40 to flow over the tapered head portion 46 into the impulse tank 24.

While the above-described ejection pump apparatus 16 functions adequately, there are many disadvantages in its design. For example, the present piston 40 includes only a small bearing land for forming a seal with the wall of the water cylinder 32. A wider bearing land would provide a more stable piston and would form a better seal with the cylinder wall. However, a wider land area would prevent the flow-through of water at the end of the piston stroke. In addition, the present water piston 40 requires that the external sea valve 34 have a diameter which is at least as large as the water piston 40 so that the water piston 40 can be installed into the water cylinder 32 through the sea valve 34. Large diameter sea valves are costly, and therefore it can be appreciated that a smaller size sea valve would be advantageous.

SUMMARY OF THE INVENTION

The instant invention provides an improved water piston which is more stable during use and which enables the intake end of the water cylinder and the sea valve to have a smaller diameter than that of the piston. In order to assemble the piston through the smaller diameter sea valve, the piston is segmented into four pie-shaped segments which are assembled together with bolt fasteners that extend through the sidewalls of the segments. The outer wall of the piston includes a circumferential slot which divides the outer wall into two spaced bearing lands that provide the piston with more stability. The circumferential slots also enable water to flow through the sidewall of the piston into the piston and outwardly through an open top thereof.

Accordingly, it is an object of the instant invention to provide a segmented piston which can be installed through an opening which is smaller in diameter than the assembled diameter of the piston.

It is another object to provide a piston which is more stable during the piston stroke.

It is yet another object to provide a piston having spaced bearing lands.

It is still another object to provide a piston which enables water to flow through the sidewall and outwardly through an open top side thereof.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

Figure 3:
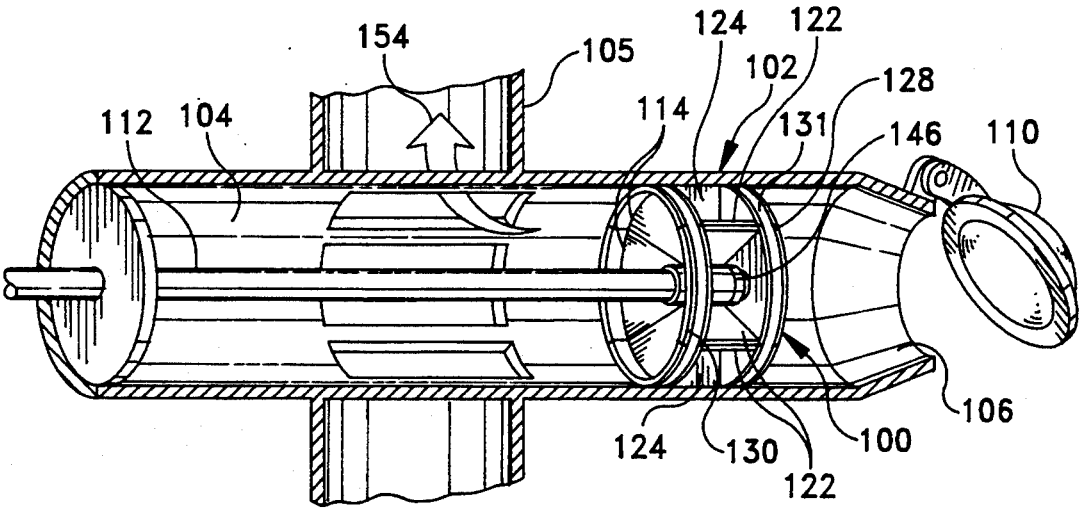
FIG. 3 is a cross-sectional view of the water cylinder and segmented flow-through piston of the instant invention.
Figure 4:
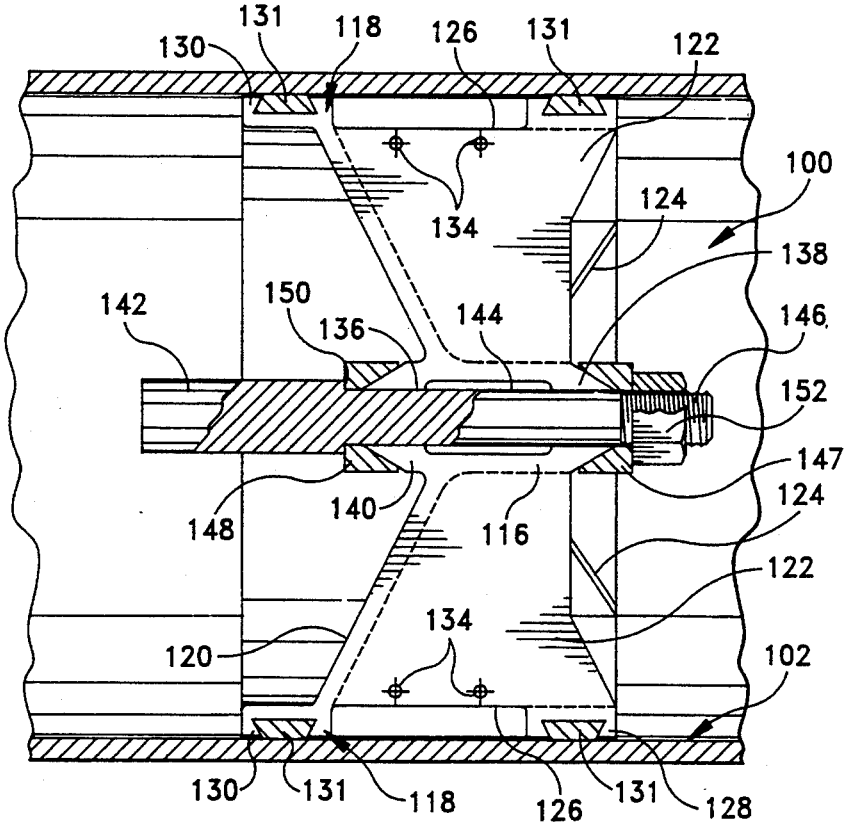
FIG. 4 is a further enlarged cross sectional view of the segmented flow-through piston.
Figure 5:
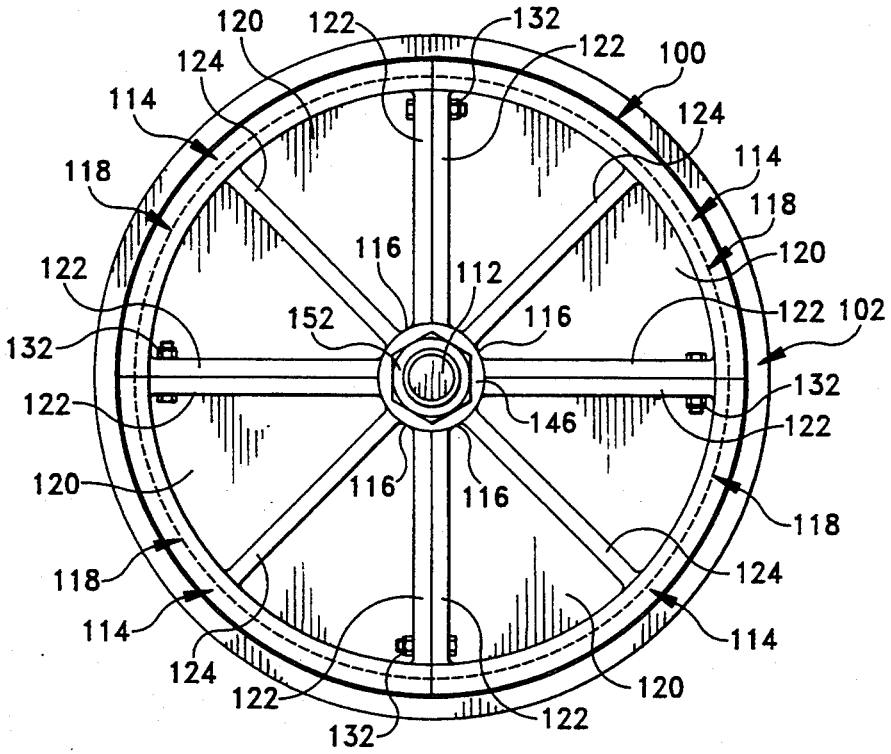
FIG. 5 is an enlarged top view of the segmented flow-through piston.

Referring now to drawing FIGS. 3, 4 and 5, the segmented flow-through piston of the instant invention is illustrated and generally indicated at 100. The segmented flow-through piston 100 is operative for use in a water cylinder generally indicated at 32 of a torpedo launching system. The basic structure and operation of the torpedo launching system is fully described in the Background portion of the specification, and therefore only the water cylinder 32 and the segmented flow-through piston 100 will be described in detail hereinafter. The water cylinder 32 has a discharge end 104, and an intake end 106. The water cylinder 32 is connected to an impulse tank 24 by a plurality of ports 38 at the discharge end 104 thereof. A sea valve 34 is mounted at the intake end 106 of the water cylinder 32 in a normal manner.

The segmented flow-through piston 100 is slidably received in the water cylinder 32 and it is movable by means of a connector rod 43 as previously described. The segmented flow-through piston 100 comprises four identical pie-shaped piston segments generally indicated at 114 each comprising a central hub portion 116, an arcuate outer wall portion generally indicated at 118, a bottom wall portion 120, and two radial sidewall portions 122 extending between the central hub portion 116 and the outer wall portion 118. Each of the piston segments 114 also includes a radial stabilizing vane 124. The arcuate outer wall portions 118 each have a circumferential slot 126 which divides the arcuate outer wall 118 portion into upper and lower bearing lands 128 and 130 respectively. Each of the bearing lands 128 and 130 includes a circumferential rubber gasket 131 which provides a substantially water tight seal against the inner wall of the water cylinder 32. The piston segments 114 are secured together in adjacent relation by bolt fasteners 132 (FIG. 5) which are extended through apertures 134 (FIG. 4) in the sidewalls 122. It is pointed out that the piston segments 114 must be assembled inside the water cylinder 32 through the intake end 106 of the water cylinder 32 and the sea valve 34. It is also pointed out that the intake end 106 of the water cylinder 32 and the sea valve 34 have a smaller diameter than the assembled diameter of the piston 100. The instant water cylinder 32 is able to have this smaller diameter because the segmented design of the piston 100 enables the piston 100 to be installed into the water cylinder 32 through an opening which is less than the assembled diameter of the piston.

The assembled piston segments 114 form a unitary cylindrical piston having a central hub 116, an outer wall 118, a frustoconical bottom wall 120 and a plurality of radial vanes 124. It is pointed out that the sidewalls 122 also form radial vanes when the piston segments 114 are fully assembled. The central hub 116 of the piston 100 has an axial bore 136 and frustoconical outwardly tapering upper and lower ends, 138 and 140 respectively. A connector rod 48 has a reduced diameter end portion 144 and a threaded terminal end 146. The reduced diameter end portion 144 is received through the axial bore 136 in the hub 116 of the piston 100. For securing the piston 100 onto the connector rod 48, the piston 100 includes two frustoconical, inwardly tapering washers, 146 and 148 respectively, which are matingly received over the outwardly tapering upper and lower ends 138 and 140 of the central hub 116 and are captured between a shoulder 150 of the connector rod 48 and a threaded bolt 152 received over the terminal end 146 of the connector rod 48.

Figure 1:
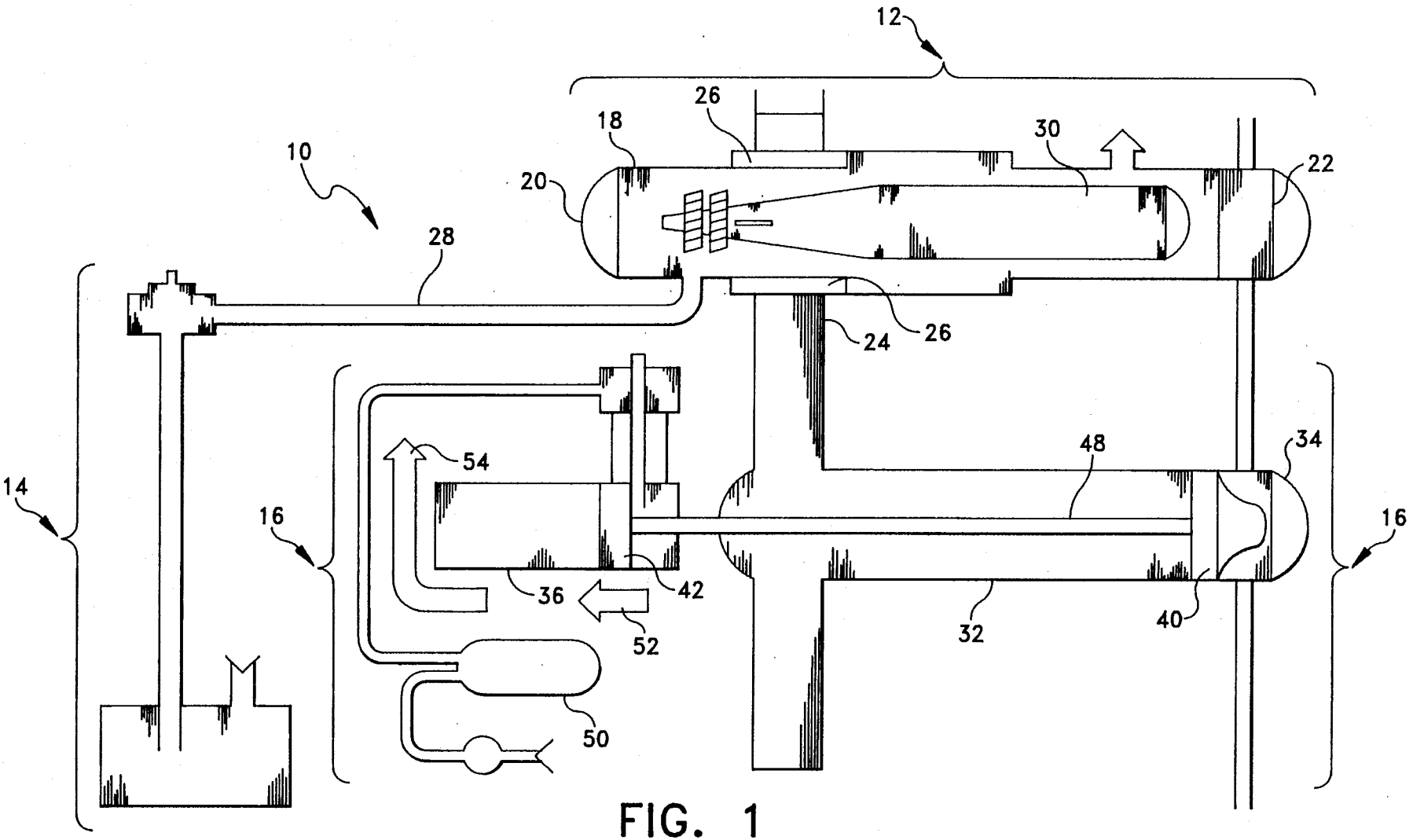
FIG. 1 (PRIOR ART)
FIG. 1 is a cross-sectional view of a conventional torpedo launching system.
Figure 2:
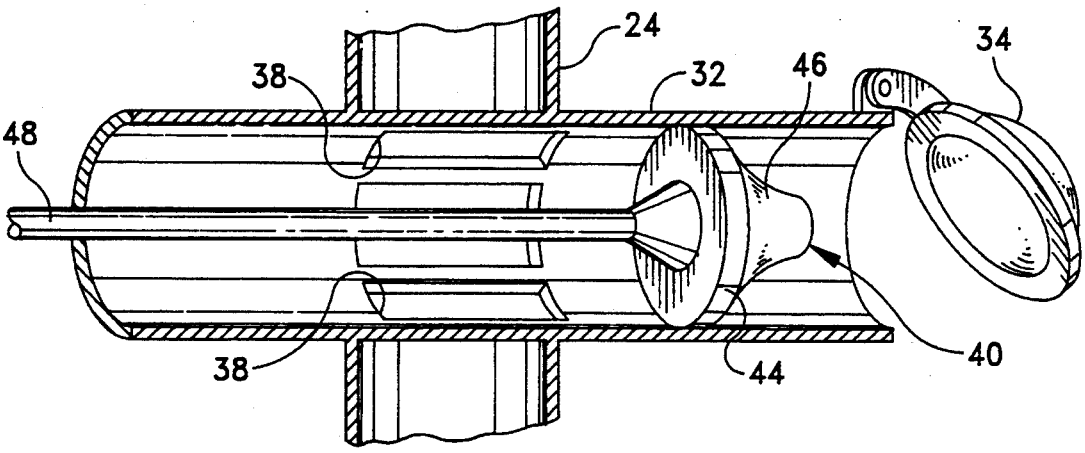
FIG. 2 (PRIOR ART)
FIG. 2 is an enlarged cross-sectional view of the water cylinder portion of the ejection pump apparatus.

In use of the water cylinder 32 and the segmented flow-through piston 100, the water cylinder 32 is charged with sea water by opening the sea valve 34 in a normal manner. Once the water cylinder 32 is charged with sea water, the segmented flow-through piston 100 is pulled to the discharge end 104 of the water cylinder 32 wherein the water in the water cylinder 32 is forced into the impulse tank 106 and then into the torpedo tube (See FIG. 1) to force the torpedo out of the tube. It is pointed out that the spaced bearing lands 128 and 130 on the outer wall 118 of the segmented flow-through piston 100 provide a high degree of stability to the piston 100 as it is moved in the cylinder 32. As the segmented flow-through piston 100 nears the end of the ejection stroke, the lower bearing land 130 moves past the ducts 108 allowing water on the far side of the piston 100 to flow through the outer wall 118 into an interior of the piston 100 and outwardly through an open top of the piston 100 back into the impulse tank 106.

It can therefore be seen that the instant invention provides a unique piston 100 which is more stable during use and which enables the intake end 106 of the water cylinder 32 to have a smaller diameter than the diameter of the piston 100. The piston 100 comprises four pie-shaped piston segments 114 which are assembled together inside the water cylinder 32 to form a unitary piston. Each of the piston segments 114 includes an outer wall 118 with a circumferential slot 126 therein. The circumferential slots 126 provide two spaced bearing lands 128 and 130 which provide added stability to the piston 100, while they also allow fluid to pass through the outer wall 118 into an interior of the piston 100 and outwardly through an open top of the piston 100. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A segmented flow-through piston comprising:

at least three pie-shaped piston segments each comprising a central hub portion, an arcuate outer wall portion, a bottom wall portion, and two radial sidewall portions extending between said central hub portion and said outer wall portion, said arcuate outer wall portion having a circumferential slot therein which divides said arcuate outer wall portion into upper and lower bearing lands; and means for securing said piston segments together in adjacent relation so that said piston segments form a cylindrical piston having a central hub, an outer wall, a bottom wall and a plurality of radial vanes, said circumferential slots allowing fluid to pass through said outer wall and into an interior of said piston segments, said fluid flowing outwardly through an open top of said piston.

2. In the piston of claim 1, said means for securing said piston segments together, comprising fasteners which are extended through adjacent sidewall portions of said piston segments.

3. In the piston of claim 1, said bottom wall portions of said piston segments cooperating to form a frustoconical bottom wall.

4. In the piston of claim 1, said piston further comprising a connector rod having a reduced diameter end portion, said central hub having and axial bore and outwardly tapering upper and lower ends, said reduced diameter end of said connector rod being received into said axial bore, said means for securing said piston segments together comprising inwardly tapering washers which are matingly received over said outwardly tapering upper and lower ends of said central hub and are captured between a shoulder of reduced diameter end of said connector rod and a threaded bolt received over a terminal end of said connector rod.

5. In combination, a water cylinder and segmented flow-through piston for use in a torpedo launching system, said torpedo launching system including an impulse tank:

said water cylinder having a discharge end and a reduced diameter intake end, and a reduced diamter sea valve mounted at said intake end, said water cylinder being connected to said impulse tank through a plurality of ports at said discharge end;

said segmented flow through piston comprising at least three pie-shaped piston segments each comprising a central hub portion, an arcuate outer wall portion, a bottom wall portion, and two radial sidewall portions extending between said central hub portion and said outer wall portion, said arcuate outer wall portion having a circumferential slot therein which divides said arcuate outer wall portion into upper and lower bearing lands; and means for securing said piston segments together in adjacent relation so that said piston segments form a cylindrical piston having a central hub, an outer wall, a bottom wall and a plurality of radial vanes, said segmented flow-through piston being slidably received in said water cylinder, said circumferential slots allowing fluid to pass through said outer wall and into said piston segments from said impulse tank, said fluid flowing outwardly through an open top of said piston.

* * * * *